United States Patent [19]

Stegemeier et al.

[11] Patent Number: 4,616,705

[45] Date of Patent: Oct. 14, 1986

[54] MINI-WELL TEMPERATURE PROFILING PROCESS

[75] Inventors: George L. Stegemeier; Peter Van Meurs; Cor F. H. Van Egmond, all of Houston, Tex.

[73] Assignee: Shell Oil Company, Houston, Tex.

[21] Appl. No.: 843,858

[22] Filed: Mar. 24, 1986

Related U.S. Application Data

[63] Continuation of Ser. No. 658,238, Oct. 5, 1984, abandoned.

[51] Int. Cl.[4] ..... E21B 36/04; E21B 47/06

[52] U.S. Cl. ..... 166/250; 166/60; 166/302; 166/385; 374/136; 73/154

[58] Field of Search ..... 166/250, 302, 60, 64, 166/381, 385; 73/154; 374/136

[56] References Cited

U.S. PATENT DOCUMENTS

| | | | |
|---|---|---|---|
| 2,290,075 | 4/1942 | Schlumberger | 73/154 |
| 2,383,455 | 8/1945 | Abadie | 166/250 |
| 3,114,417 | 12/1963 | McCarthy | 166/60 |
| 3,410,136 | 11/1968 | Johns et al. | 374/136 |
| 3,800,871 | 4/1974 | Watson | 166/250 |
| 3,880,234 | 4/1975 | Showalter et al. | 374/136 |
| 4,168,747 | 9/1979 | Youmans | 166/250 |
| 4,222,438 | 9/1980 | Hollingsworth et al. | 166/250 |
| 4,570,715 | 2/1986 | Van Meurs et al. | 166/60 |
| 4,572,299 | 2/1986 | Vanegmond et al. | 166/302 |

*Primary Examiner*—Stephen J. Novosad
*Assistant Examiner*—Bruce M. Kisliuk

[57] ABSTRACT

In treating a well, automatically controlled measurements of temperature with depth within a subterranean interval which can be longer than hundreds of feet, deeper than thousands of feet and hotter than 600° C., are made by extending a slender measuring means conduit through the well and the zone to be measured and arranging an electrically responsive temperature sensing means and a means for spooling a metal sheathed telemetering cable for the electrical temperature responses so that the sensing means is lowered through the measuring conduit by gravity and raised within the conduit by spooling and temperatures and/or temperature with depths are measured while the sensing means temperature is substantially in equilibrium with the temperatures in the interval being measured.

5 Claims, 4 Drawing Figures

MEASURING MEANS CONDUIT SERVING AS A HEATER CABLE GUIDE COLUMN
STATIONARY DRUM
POWER SUPPLY CABLES
ROTATING CABLE GUIDE WITH BRAKE
HEATER CABLES
WAVE LENGTH
AIR MOTOR DRIVEN GUIDE COLUMN SPOOL
HEATER END PIECE SPLICE
GUIDE COLUMN / MEASURING UNIT CONDUIT
AIR MOTOR DRIVEN CABLE SPOOL
SINKER BAR
CASINGS

MINI-WELL TEMPERATURE PROFILING PROCESS

This is a continuation of application Ser. No. 658,238, filed Oct. 5, 1984, now abandoned.

BACKGROUND OF THE INVENTION

The invention relates to a well-treating or operating process for measuring patterns or profiles of temperatures with distances within intervals of subterranean earth formations which can be long, deep and hot. More particularly, the invention relates to installing and operating equipment for obtaining such information in an economically feasible manner, particularly while a well is being operated as a temperature observation well or is being heated or utilized in a manner affecting the temperature in and around the well.

Various temperature measuring processes have been described in patents. U.S. Pat. No. 2,676,489 described measuring both the temperature gradient and differential at locations along a vertical line in order to locate the tops of zones of setting cement. U.S. Pat. No. 3,026,940 discloses the need for heating wells for removing paraffin or asphalt or stimulating oil production and describes the importance of knowing and controlling the temperature around the heater. It uses a surface located heater arranged to heat portions of oil being heated by a sub-surface heater, with the control needed to obtain the desired temperature at the surface located heater being applied to the sub-surface heater.

Various temperature measuring systems involving distinctly different types of sensing and indicating means for use in wells have also been described in U.S. patents. For example, patents such as U.S. Pat. Nos. 2,099,687; 3,487,690; 3,540,279; 3,609,731; 3,595,082 and 3,633,423 describe acoustic thermometer means for measuring temperature by its effect on a travel time of acoustic impulses through solid materials such as steel. U.S. Pat. No. 4,430,974 describes a measuring system in which a plurality of long electrical resistance elements are grouted in place within a well and sequentially connected to a resistance measuring unit to measure temperature or fluid flow.

U.S. Pat. No. 3,090,233 describes a means for measuring temperatures within a small reaction zone, such as one used in a pilot plant. A chain drive mechanism pushes and pulls a measuring means such as a thermocouple into and out of a tube extending into the reaction zone while indications are provided of the temperature and position within the tube.

In some respects, the present invention amounts to a modification of the system described in U.S. Pat. No. 3,090,233. The prior system mechanically pushed and pulled a relatively stiff measuring assembly and suggested no way in which a temperature sensing means, such as a thermocouple, could be moved for significant distances up and down within a well. But, Applicants have discovered with a certain combination of elements measurements can be made within subterranean earth formation intervals while are relatively very deep, very long, and very hot. This requires a combination of a long measuring means conduit, an electrically responsive temperature sensing means which telemeters electrical responses along a metal sheathed telemetering cable which is heat stable, a flexible weighting means connected below the sensing means and a means for spooling the telemetering cable and requires that those elements be arranged to have physical and chemical properties which are properly interrelated. In addition, Applicants found that in contrast to previously described methods for measuring sub-surface temperatures within wells, the presently described interrelated combination of elements is particularly beneficial in being capable of providing substantially equilibrated temperature measurements from all points along a long interval of subterranean earth formations without involving any more man hours than are needed for the quick scan of a computer printout. In contrast, the prior methods for obtaining such temperature logs have required continual attendance, and delayed well operation, for days or weeks.

SUMMARY OF THE INVENTION

The present invention relates to a process for treating and/or operating a well while measuring temperatures in or around a well within subterranean intervals which can be hundreds of feet long, thousands of feet deep, and hot enough to require pyrometric measurements. A long, substantially straight measuring means conduit is extended within the well from a surface location to the interval to be measured. A flexible weighting member, an electrically responsive temperature sensing means, a spoolable heat stable cable for telemetering the sensing means signals and a means for spooling in and paying out the telemetering cable are arranged and interconnected so that the gravitational force on the weighting means is capable of substantially straightening the bends in the telemetering cable, and pulling the temperature sensing means and telemetering cable downward within the measuring means conduit without significantly cold working the cable during the bending and straightening of it. The spooling means is operated so that the temperature sensing means is pulled downward within the measuring interval by gravity and is pulled upward within that interval by spooling the telemetering cable onto a drum. The rate of the movement is controlled so that electrical temperature responses are telemetering from the temperature sensing unit while that unit is, to the extent desired, in substantial temperature equilibrium with the temperatures encountered within the measuring interval. Indications are made of temperature corresponding to the telemetered electrical responses and temperature measuring locations corresponding to the position of the temperature sensing means, which position corresponds to the extent of the unspooling of the telemetering cable from the spooling means.

DESCRIPTION OF THE INVENTION

Figures 1, 2:
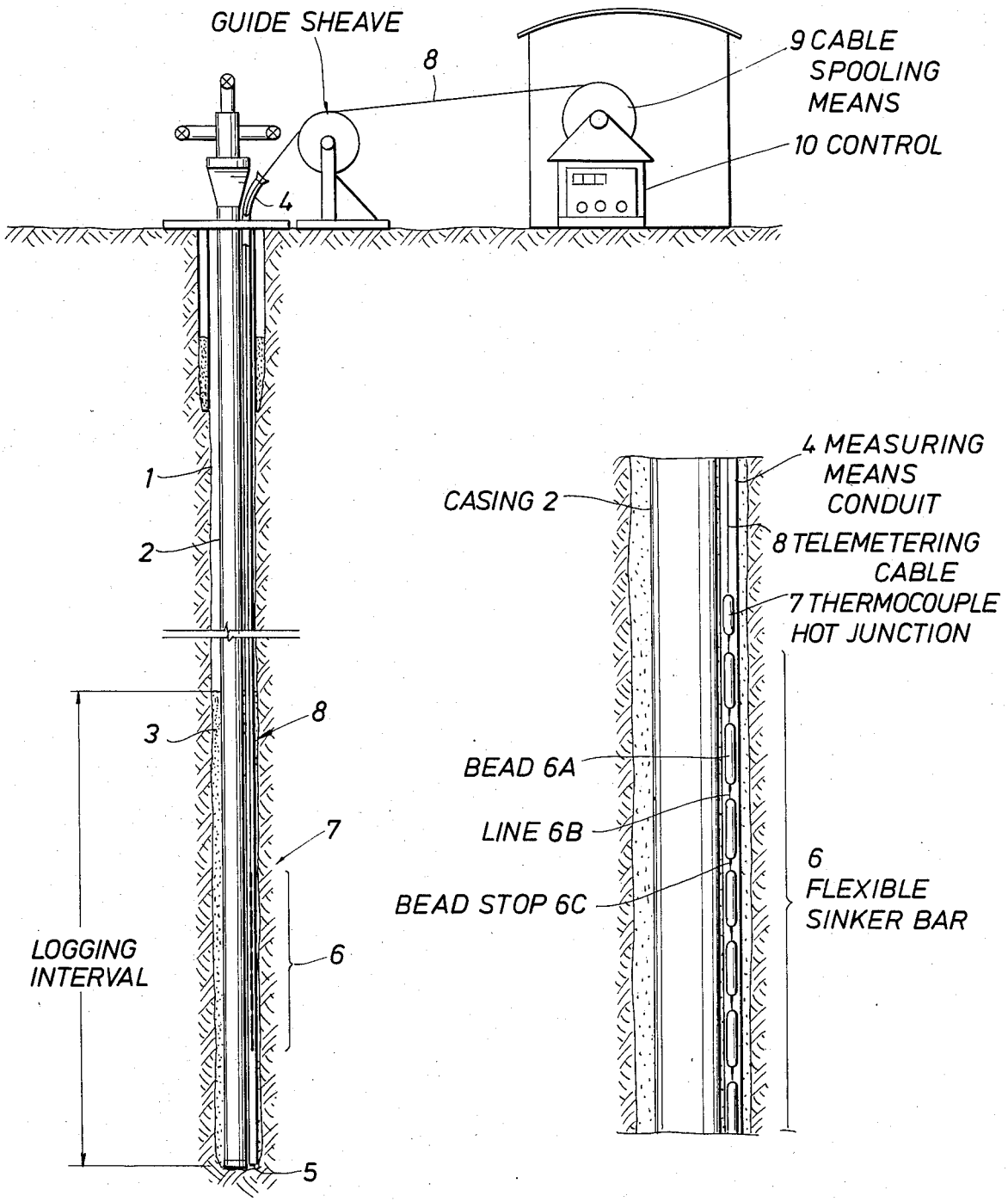
FIG. 1 is a schematic illustration of the system of the present invention installed in a mini-well or measuring means conduit extending alongside a string of casing cemented within a well.
FIG. 2 is an enlarged view of a section of that mini-well.

FIG. 1 shows a borehole 1 in which a string of casing 2 is installed and grouted by cement 3. Such a way may, for example, be a temperature observation well, a well in which a heater is being operated to mobilize a viscous oil or to coke a portion of the coil in a reservoir to form a sand consolidated zone or an electrode to which electrical current is to be flowed through the reservoir, or the like.

A slender measuring means conduit 4 is extended along the casing 2 into and through a "logging" interval to be measured. The conduit 4 is preferably spoolable and is strapped to a pipe string such as casing 2 and surrounded by a body of cement, such as cement 3, which surrounds the casing to ensure a substantially uniform heat transport to or from the earth formation and avoid the flow of fluid into or out of the casing. The measuring means conduit is preferably tightly closed by a bottom located seal 5 which can be, for example, a cap, a plug, a weld, a body of cement, or the like.

A temperature sensing assembly comprising a flexible weighting member or "flexible sinker bar" 6, a thermocouple hot junction 7 and a thermocouple signal telemetering cable 8 (more clearly depicted in FIG. 2) are disposed within the measuring means conduit 4. The flexible weighting member or flexible sinker bar 6 comprises a series of sinker bar beads (i.e., short weights) 6A slidably connected around a flexible line 6B, and kept separated from each other by bead stops 6C, which are fixedly attached to line 6B.

The telemetering cable 8 for transmitting the electrical responses from the thermocouple hot junction preferably comprises the thermocouple wires, or conductive wires having similar thermal electrical characteristics, insulated by nonconductive solid material which is suitably heat stable for use at the temperature being measured. As known to those skilled in the art, although thermocouples were first developed for use in pyrometry they are now competitive with resistance thermometers and various expansion and pressure types of thermometers, for measuring lower ranges of temperatures, and with radiation methods for measuring very high temperatures.

The position of a temperature sensing means 7 within the interval to be measured corresponds to the extent the cable 8 is unspooled from the cable spooling means 9. The cable spooling means control 10 controls the rate at which the temperature sensing means is moved within the interval being measured.

In general, the controls are arranged to adjust the speed and torque of the spooling drive motor. The travel rates are preferably variable from about 3 to 2,000 inches per minute. The unspooling rate should, of course, be kept slow enough to avoid spiraling or kinking of the telemetry cable. A particularly suitable logging rate is about 6 inches per minute which provides a traverse of 300 feet of subterranean earth formation interval in about 10 hours. The electrical response temperatures are transmitted (for example, by a mercury slip-ring assembly) to measurement indicating units.

The measuring means conduit is preferably a spoolable continuous stainless steel tube, preferably one which has an inner diameter of about 5/16ths to 9/16ths of an inch and is, or is substantially equivalent to, a grade 316 stainless steel. The measuring means conduit is preferably attached, for example, by strapping, along the exterior of a tubing or casing string. The points of the attachment should be located at the largest diameters of such a pipe string, e.g., at the pipe collars, to keep the measuring means conduit as straight as possible, particularly with respect to avoiding a spiraling around a casing or tubing to which the measuring means conduit is attached.

The sinker bar beads such as beads 6A used in a conduit of the preferred size preferably have an outer diameter of about 3/16ths to 7/16ths inch and a length of about 1 to 6 inches. In such an arrangement, the flexible sinker line 6B is preferably a flexible line such as a 1/16ths inch aircraft wire and the bead stops 6C are preferably small pieces of small tubing such as ⅛th-inch tubing crimped tightly onto the sinker line in positions that keep the beads separated by about ½-inch.

In general, the components of the combination comprising a flexible weighting member like flexible sinker 6, an electrically responsive temperature sensing means like thermocouple junction 7, a metal sheathed telemetering cable like cable 8 and a means for spooling the telemetering cable like spooling means 9, should have chemical and physical properties and interconnections arranged so that gravity acting on the sinker bar is capable of pulling the sensing means downward through the measuring interval while substantially straightening the bends imparted by the drum of the spooling means. Applicants have found, by means of well tests, that such an arrangement and interconnection of properties is exemplified by a measuring means conduit comprising a ⅜ths-inch inside diameter by ½-inch outside diameter 316 stainless steel tube, a flexible sinker bar comprising 80 beads which are 2 inches long by ¼th-inch diameter (providing a total weight of about 2 pounds and a length of about 17 feet), where the cable for telemetering electrical temperature responses is a steel sheathed 1/16ths-inch diameter cable which is spooled on a spooling means having a drum diameter of about 19 inches.

With respect to such a combination of items the cold working of the telemetering cable (due to being bent around the spooling means drum) is only about 0.3 percent. Where the measuring means conduit deviation from a generally vertical line (with respect to spiraling or substantially reversing turns, such as "dog legs") is practically nil, the temperature sensing means not only moves smoothly downward in response to gravity (with no evidence of interference due to friction) but no significant load due to friction is apparent while raising the system by spooling it onto the spooling means drum. Tests have indicated that where the same combination of items is used in a measuring means conduit having spiraling deviations from the vertical, although the downward motion may be satisfactory, the pulling up of the system may place a load on the telemetering cable amounting to more than its tensile strength, due to friction.

Figure 3:
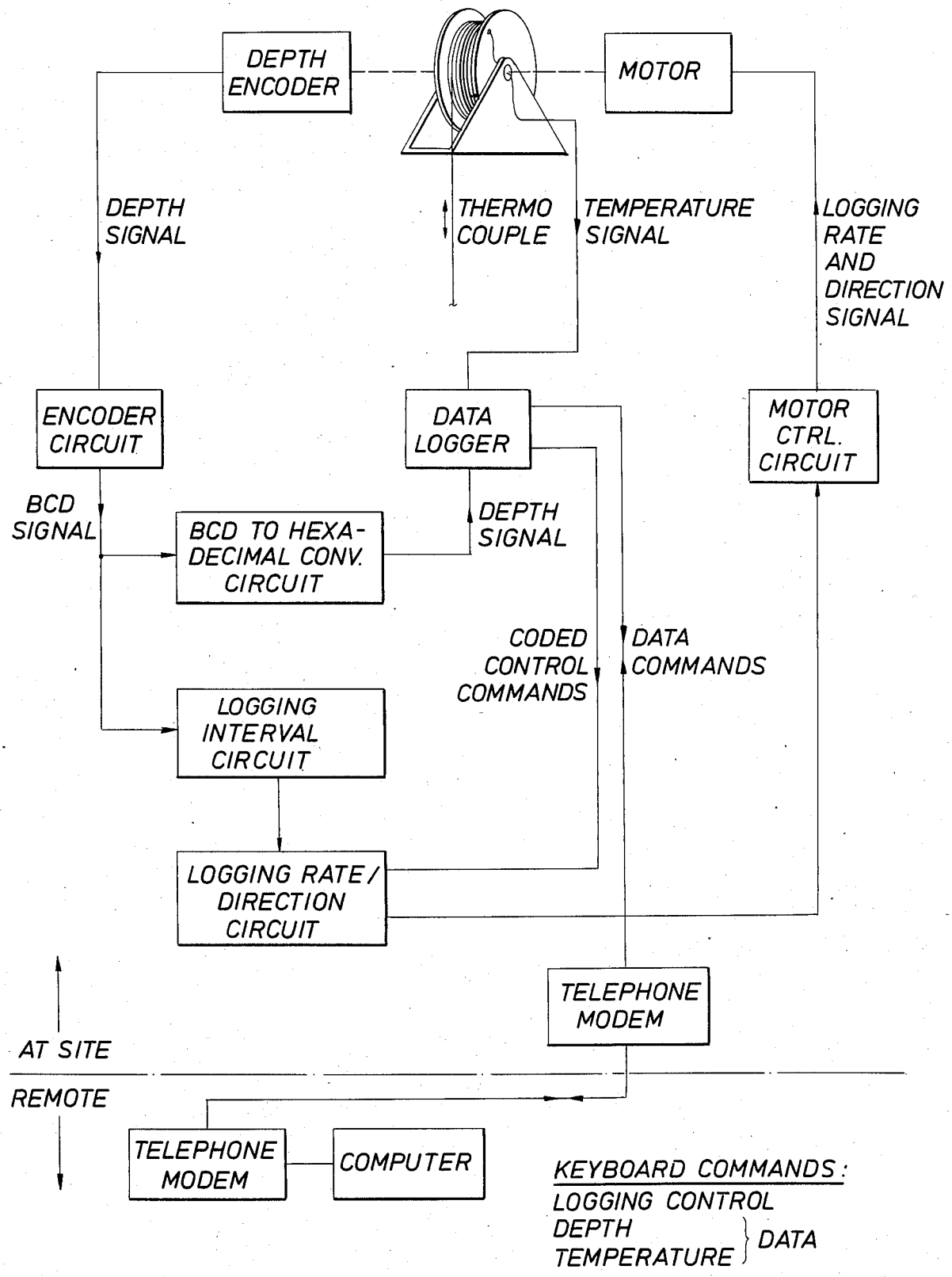
FIG. 3 is a block diagram of circuits for controlling the operations of the spooling means shown in FIG. 1.

FIG. 3 shows the main circuitry components for controlling a cable spooling means such as means 9 of FIG. 1. As will be apparent to those skilled in the art, substantially all of the indicated components can be the same as, or like, components which are commercially available. A data logger is arranged to receive depth and temperature signals and transmit coded control commands to a logging rate and direction control circuit, which in turn activates a motor control circuit to provide direction and rate signals to the spooling means motor. A depth encoder derives thermocouple position indicating signals from the extent at which the telemetering cable 8 is unspooled. The binary coded decimal depth signals are converted to hexadecimal depth signals which are supplied to the data logger, along with the temperature signals from the thermocouple.

The data logger is arranged to provide data and receive commands, via a telephone modem, to and from on site and/or remote locations. The available keyboard commands include logging control direction, logging speed and data regarding depth and temperature. Thus, the system can automatically accumulate temperature measurements at a continuous or intermittent rate which is slow enough to ensure substantial equilibrium between the sensing unit and the surrounding temperature without any interruption of the well operation or any significant amount of time of the operating personnel. Where a subterranean interval is to be heated at a relatively high temperature, the present process can be particularly valuable. The measuring conduit means conduit is extended throughout the interval near the heater to be used. While operating the heater to bring it up to the selected heating temperature the logging speed for the temperature sensing assembly is set to provide relatively rapid traverses of the interval in order to detect any developing hot spots anywhere along the intervals before any significant damage has occurred. When the heater temperature reaches or approaches the selected heating temperature the logging speed can be reduced to a rate conducive to maintaining a thermal-equilibrium between the sensing means and the borehole temperature.

The use of the telephone modem is also particularly advantageous in mountainous terrain where radio communications or personnel monitoring is difficult or impractical. The present system can be used for a central control of a large number of heat injectors in a field scale operation.

Figure 4:
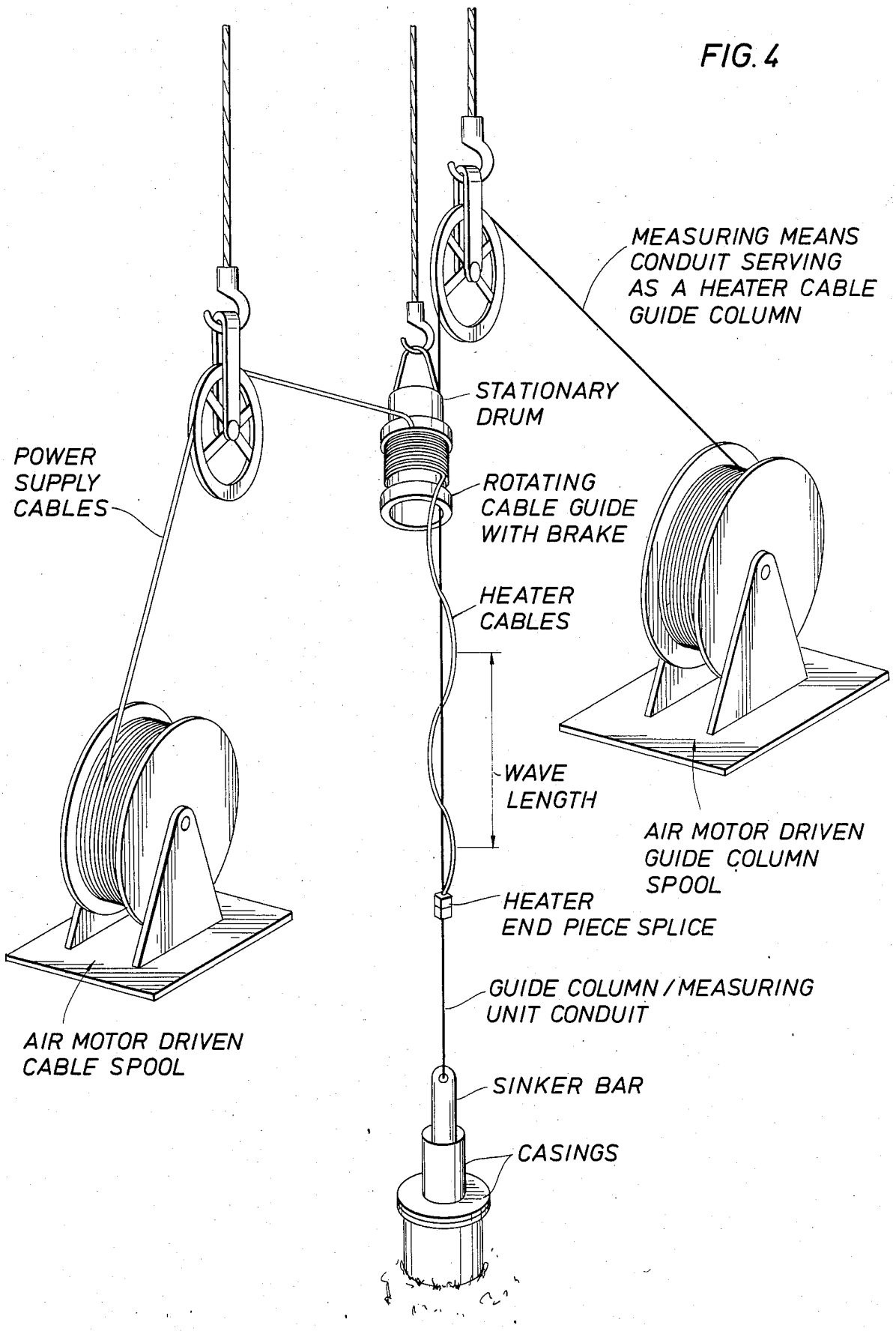
FIG. 4 is a schematic illustration of an alternative arrangement in which a measuring means conduit of the present invention is used as both a mini-well and a guide column for a heater cable.

FIG. 4 shows an alternative arrangement of a placement and use of a measuring means conduit, in accordance with the present invention. The system shown in FIG. 4 is a formation-tailored method and means for uniformly heating a long subterranean interval at high temperature. It is described in a commonly assigned application, Ser. No. 597,764 filed Apr. 6, 1984. The disclosures of that application are incorporated herein by reference.

As shown in FIG. 4, the measuring means conduit is arranged to serve as a heater cable guide column. It is pulled from an air motor driven guide column spool through the interior of a stationary drum and into a well casing by the weight of a guide column sinker bar. A pair of heater cables each comprising a conductive metal core surrounded by mineral insulation encased in a stainless steel sheath are connected to a pair of metal sheathed, mineral insulated, power supply cables and lengths of those cables which are sufficient to allow the heater cables to extend through the casing to the zone to be heated are wound around a rotating cable guide mounted on the stationary drum through which the tubular guide column is extended. The heater cables are spliced together with an end piece splice which is connected to the guide column. As the guide conduit is lowered into the casing, turns of the heater cables followed by turns of the power supply cables are removed and fed into the casing in the form of spiraling coils in which the turns have a suitable wave length. When the downward travel of the guide column is terminated, the coils of the cables press outward against the inner wall of the casing and much, if not all, of their weight tends to be supported by the friction between them and the wall.

In such an arrangement, in accordance with the present process, after a guide column comprising the measuring means conduit of the present invention has been run-in, it is preferably hung from a wellhead hanger, which can be like those conventionally used for hanging strings of continuous tubing. If a pressure greater than atmosphere is to be generated within the casing containing the measuring means conduit, the temperature sensing assembly of the present invention can be fed in through a lubricator, which can be like those conventionally used. The lubricator should, of course, be arranged so that the friction imparted by it does not prevent the gravity-actuated downward travel of the temperature sensing means.

What is claimed is:

1. In a process in which an elongated electrical resistance heater is installed and operated within a well for substantially uniformly heating an interval of subterranean earth formations which interval is longer than about 100 feet and is heated to a temperature between about 600° C. and a temperature damaging to the well or earth formation, an improvement for installing and operating the heater and measuring the pattern of temperature with depth along the heater, comprising:

positioning a spooled electrical heater and a spooled tubular stainless steel measuring conduit having an internal diameter of from about 5/16ths to 9/16ths inch at the well site and unspooling the heater and conduit substantially simultaneously into the well while periodically attaching the heater to the conduit so that the conduit supports the weight of the heater;

interconnecting a flexible weighting member, a thermocouple and a metal-sheathed cable for telemetering thermocouple responses, with those elements having outer diameters small enough to slide freely within the measuring conduit;

arranging the telemetering cable and a means for spooling and unspooling the metal-sheathed cable so that (a) the gravitational force on the weighting means is capable of pulling the thermocouple and cable downward within the measuring conduit means while the cable is being unspooled and substantially straightening the bends imparted to the cable by the spooling means drum and (b) the correlation between the gravitational force on the weighing means and the diameter of the spooling means is such that the cold working of the cable is not more than about 0.3 percent;

arranging the metal-sheathed cable spooling means for unattended automatic operation capable of moving the thermocouple through the interval being heated at a rate of about 3 to 2000 inches per minute capable of maintaining a substantial thermal equilibrium between the thermocouple and the temperature within the well; and operating the heater while measuring the pattern of temperature with depth throughout the interval.

2. The process of claim 1 in which the cable spooling means is operated automatically.

3. The process of claim 1 in which the bottom of the measuring means conduit is fluid-tightly sealed.

4. The process of claim 1 in which the thermocouple temperature sensing means is initially cycled through said zone at relatively high rates to detect any developing hot spots and is later cycled at rates such that it remains in substantial thermal equilibrium with the surrounding temperature.

5. The process of claim 1 in which the thermocouple temperature sensing means is unattended and is automatically moved through the interval being heated at a rate keeping said means in substantial thermal equilibrium with the surrounding materials.

* * * * *